United States Patent [19]

Lehman

[11] 4,134,229

[45] Jan. 16, 1979

[54] ILLUMINATED FLYING SAUCER TOY

[75] Inventor: James A. Lehman, El Cajon, Calif.

[73] Assignee: Warner-Lehman Corporation, El Cajon, Calif.

[21] Appl. No.: 755,841

[22] Filed: Dec. 30, 1976

[51] Int. Cl.[2] ..... A63H 33/28; A63B 65/10

[52] U.S. Cl. ..... 46/228; 46/74 D

[58] Field of Search ..... 46/228, 74 D, 62; 273/10 CD

[56] References Cited

U.S. PATENT DOCUMENTS

| | | | |
|---|---|---|---|
| 3,082,572 | 3/1963 | Knox, Jr. | 46/74 D |
| 3,531,892 | 10/1970 | Pearce | 46/62 |
| 3,720,018 | 3/1973 | Peterson et al. | 46/74 D |
| 3,786,246 | 1/1974 | Johnson et al. | 46/74 D |

FOREIGN PATENT DOCUMENTS

| | | | |
|---|---|---|---|
| 2246469 | 3/1973 | Fed. Rep. of Germany | 273/106 B |

*Primary Examiner*—Louis G. Mancene
*Assistant Examiner*—Robert F. Cutting
*Attorney, Agent, or Firm*—Frank D. Gilliam

[57] ABSTRACT

The invention is a flying saucer toy of the hand-tossed variety utilizing an illumination plant mounted beneath the central portion of the saucer body and having a light transmitting dome covering the light element beneath the saucer body so that the saucer is visible from beneath, the illumination plant preferably extending beneath the peripheral lip of the saucer for purposes of stability, and in some cases increased visibility, and to cause the saucer to rest asymmetrically on the ground to permit easy retrieval by a dog or a person between tosses.

4 Claims, 6 Drawing Figures

ILLUMINATED FLYING SAUCER TOY

BACKGROUND OF THE INVENTION

The present invention is in the field of hand-tossed flying saucer toys and comprises an embellishment on the basic flying saucer which has become quite popular in the last decade.

A flying saucer toy has been produced of a plastic that is phosphorescent so that it may be tossed after dark, which is a significant improvement in the game inasmuch as beach parties and the like often carry on after dark, and it is at this type of function particularly that the saucers are used. The saucer, although a definite improvement for night use, still does not radiate enough light energy to provide night playing with the ease of day playing.

SUMMARY OF THE INVENTION

The present invention includes an illumination plant having a power pack and a light element which are selfcontained in the saucer so that it may be used in total darkness with a facility almost equal to daytime playing. In addition to this simple provision of an illumination source on the saucer toy, the illumination plant in its two embodiments disclosed is so designed that the center of gravity of the saucer is lowered for additional in-flight stability, a pedestal is provided for landing the saucer, and visibility is improved in one embodiment by providing direct line-of-sight visibility from the side to the illuminated dome beneath the saucer body.

BRIEF DESCRIPTIONS OF THE DRAWINGS

DETAILED DESCRIPTION OF THE PREFERRED EMBODIMENTS

Figure 1:
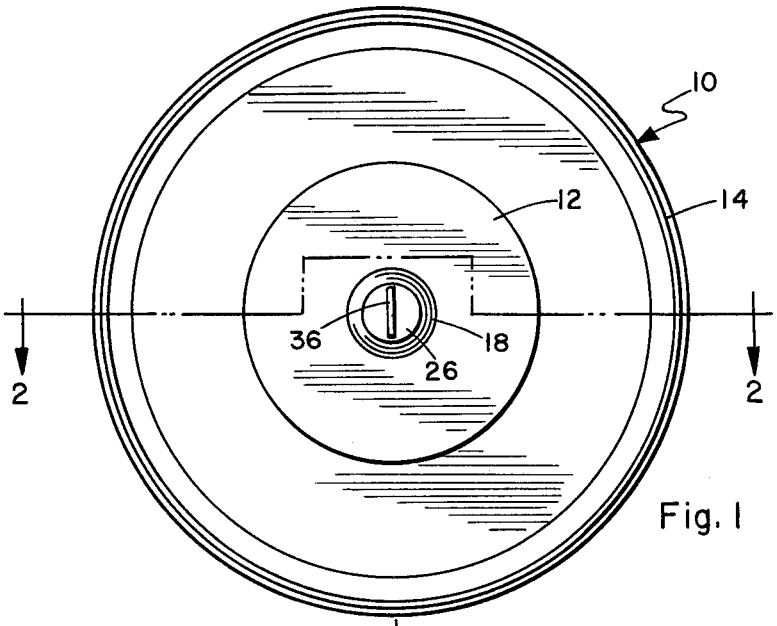
FIG. 1 is an underside view of the saucer.
Figure 2:
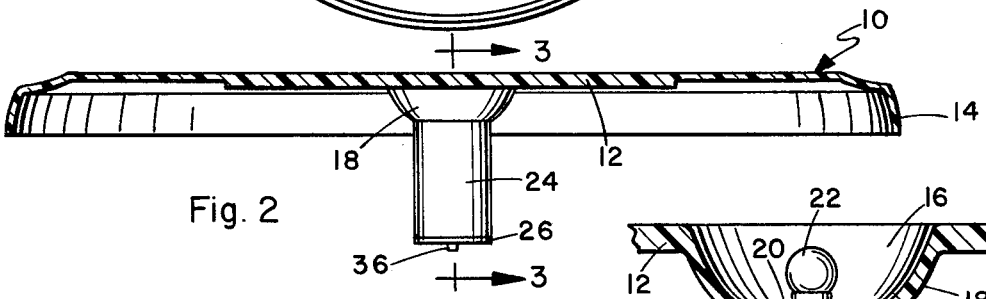
FIG. 2 is an enlarged sectional view taken on line 2—2 of FIG. 1.

FIGS. 1 and 2 illustrate a flying saucer body similar to those currently in use having a central portion which is thickened at 12 in the present invention to provide support for the added structure, and a depending peripheral lip 14 is provided to accommodate engaging the saucer by the fingers and to provide lift.

Figure 3:
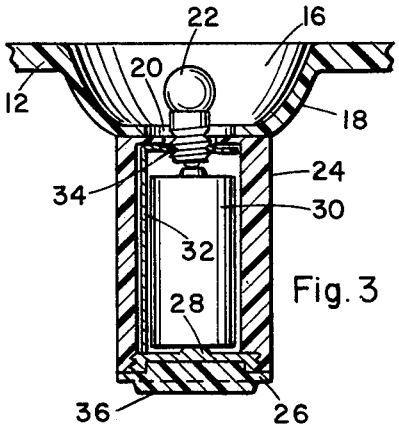
FIG. 3 is a further enlarged sectional view taken on line 3—3 of FIG. 2.

In the embodiment represented in FIGS. 1 through 3 the center of the saucer body incorporates, an upwardly open cavity 16 defined by a lens or cover 18 which is light transmitting, being either tinted, translucent or transparent. The cover is shown as being integral with the remaining portions of the saucer body but of course could be made separately and attached in any convenient fashion.

The center of the cover 18 has an opening 20 through which projects a light bulb 22. A battery housing 24 is cemented or otherwise attached to the bottom of the cover 18, this housing being open at the bottom to receive a threaded plug 26 which has a metallic upper surface 28 which could be a metal washer or a coating of metallic foil. This cover makes contact both with the battery 30 which is seated in the housing and a conductive strip 32 which in conventional flashlight fashion articulates a socket 34 to receive in threaded engagement the base of the light bulb 22. The bottom of the plug 26 has a rib 36 or other equivalent structure to permit unscrewing of the plug with the fingers for removal of the battery. The light bulb can be removed from the topside of the cavity 16 without dismantling any other structure, and although some sort of switch could be provided, the light bulb could equally well be de-energized simply by loosening it somewhat when the saucer is not in use.

Other dispositions of the power plant could be conceived in which the battery housing does not project to the extent that it does in the embodiment of the invention in FIGS. 1 through 3. The battery housing is extended downwardly for several reasons rather than being more compactly arranged in this embodiment. One purpose is to provide a significant lowering of the center of gravity which takes advantage of the relative heaviness of the battery compared to the rest of the structure. Because the center of lift is ordinarily about even with or even below the center of gravity in a conventional flying saucer the unit is unstable and must depend on the gyroscopic effect of spinning for its stability. Suspending the battery beneath the saucer body lowers the center of gravity beneath the center of lift so that ideally stability is achieved even without spinning, although of course the saucer would ordinarily be spun as it is tossed.

Another advantage inherent in the use of a central member which depends below the lower edge of the lip 14 is the fact that when the saucer is missed by the opposing player and comes to rest on the ground, it is much easier to quickly grab with one hand because most of the edge of the saucer will be tilted upwardly off the ground. This also is especially advantageous when a dog's master is using the toy in a retrieval mode. Conventional flying saucers are difficult for a dog to pick up with his jaws, especially from a hard flat surface. Also, sometimes both hand are required for a person to quickly retrieve the saucer from a concrete playing surface.

Figure 4:
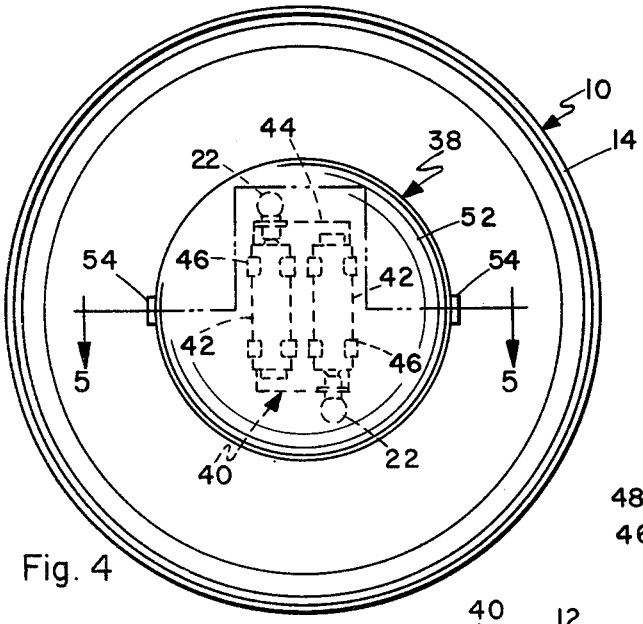
FIG. 4 is an underside view of a saucer with an alternative lighting arrangement.
Figure 5:
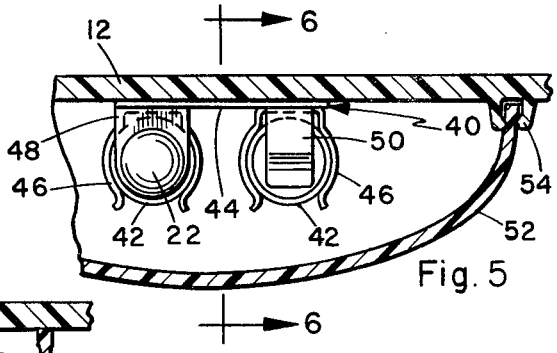
FIG. 5 is an enlarged sectional view taken on line 5—5 of FIG. 4.
Figure 6:
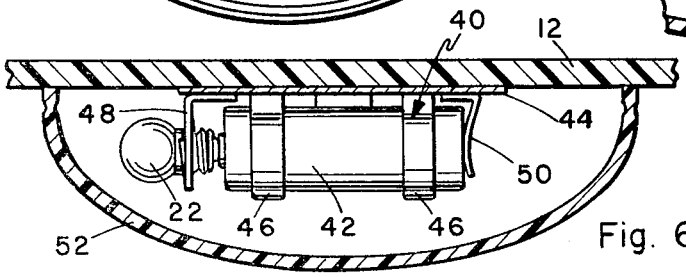
FIG. 6 is a sectional view taken on 6—6 of FIG. 5.

Turning now to the second embodiment of the invention represented in FIGS. 4 through 6, in this case the illumination plant, generally indicated at 38, comprises a metallic mounting bracket 40 for batteries 42 constituting an upper plate 44 cemented or riveted to the center of the saucer body 10 and having conventional battery clips 46 engaging the batteries. Flanges 48 and 50 makes contact with the bulb and rear end of the battery respectively, the flanges 48 also defining a socket for the bulb bases.

In this embodiment a light transmitting lens or cover 52 is provided which extends over the entire illumination plant consisting of the batteries and light bulbs and their mounting structure. This dome shaped cover is retained on the underside of the saucer body by clips 54 so that it may easily be snapped on and off by the players.

The dome preferably depends beneath the lower edge of the peripheral lip of the saucer and serves the same purpose of supporting an edge of the saucer above the ground as does the battery housing in the first embodiment. Also an added function is served, that being the positioning of a portion of the light source beneath the edge of the saucer so that the light may be seen even directly horizontally from the saucer.

The flying saucer toy as described above introduces a new dimension into the sport of saucer tossing and in addition to permitting night play with equal facility as daytime use, the added advantages of increased in-flight stability, and added ease of retrieval are both incorporated in each of the embodiments as shown and claimed herein.

I claim:

1. An illuminated hand-tossed flying saucer toy comprising:

a saucer shaped body;

an illumination plant centrally mounted to the underside of said body, said illumination plant comprising battery means, lamp means, clamp means spanning the length of said battery means, said clamp means has physical contact with one end of said battery means and includes a socket at its other end for holding said lamp means in physical contact with said battery means causing said lamp to illuminate, said illumination plant further includes a light-transmitting cover for enclosing said illumination plant;

said body has a downcurved peripheral lip to provide for gripping and lift, and said illumination plant extends below said lip to provide said flying saucer toy with increased airborn stability and to support said toy asymmetrically on the ground to facilitate quick pickups during play.

2. Structure according to claim 1, wherein said illumination plant further includes a cylindrical battery housing coaxial with said saucer-like body and joined at its upper end to said light-transmitting cover, said battery housing and battery extending below said lip to stabilize said body and support same asymmetrically on the ground.

3. Structure according to claim 2 wherein said toy further comprises a lens which is integral with said body and defines an upwardly open cavity in substantially the center of said body and said light element is seated in said cavity.

4. Structure according to claim 1, wherein said light-transmitting cover is a dome and said battery and said light element are contained within said dome, and said dome extends beneath the lower edge of said lip to provide stability, asymmetrical ground posture, and visibility beneath said lip.

* * * * *